United States Patent [19]

Prevosto

[11] Patent Number: 4,834,626

[45] Date of Patent: May 30, 1989

[54] PERFECTED PORTABLE MOTOR-DRIVEN COMPRESSOR SET

[75] Inventor: Gianfranco Prevosto, Turin, Italy

[73] Assignee: Taer S.r.l., Italy

[21] Appl. No.: 149,412

[22] Filed: Jan. 29, 1988

[51] Int. Cl.[4] ..... F04B 1/16; F04B 27/08

[52] U.S. Cl. ..... 417/415; 417/534

[58] Field of Search ..... 417/415, 423 R, 423 A, 417/423 E, 423 F, 441, 312, 534, 538, 571, 535, 536, 537; 92/128, 163, 164

[56] References Cited

U.S. PATENT DOCUMENTS

| | | | |
|---|---|---|---|
| 1,036,918 | 8/1912 | Sebald | 417/536 |
| 1,130,959 | 3/1915 | Campbell | 47/536 X |
| 1,474,769 | 11/1923 | Dunning | 417/534 |
| 3,351,271 | 11/1967 | Bellmer | 417/571 X |
| 4,190,402 | 2/1980 | Meece et al. | 417/415 |
| 4,422,831 | 12/1983 | Schmid | 417/441 X |
| 4,529,365 | 7/1985 | Schutt et al. | 417/415 X |
| 4,597,721 | 7/1986 | Santefort | 417/454 X |

*Primary Examiner*—Carlton R. Croyle
*Assistant Examiner*—Eugene L. Szczecina, Jr.
*Attorney, Agent, or Firm*—Kane, Dalsimer, Sullivan, Kurucz, Levy, Eisele and Richard

[57] ABSTRACT

A portable motor-driven compressor set on which the output shaft of a motor drives an opposed-piston compressor rigidly connected to the motor frame, characterized by the fact that the compressor consists of a pair of heads arranged one on top of the other and each having a valve plate, a cylinder for a respective piston, and a half casing, all formed in one piece and preferably die-cast in aluminium; the aforementioned half casings being secured together end-to-end with their respective cylinders coaxial, and the pistons also being formed integral in one piece and with a respective connecting rod having a slot housing the drive shaft, and a seat for a cam controlled by the aforementioned shaft.

7 Claims, 2 Drawing Sheets

PERFECTED PORTABLE MOTOR-DRIVEN COMPRESSOR SET

BACKGROUND OF THE INVENTION

The present invention relates to a perfected portable motor-driven compressor set, specially designed for amateur or professional medium-light-duty applications.

Compressors, especially medium-small-size types, are known to present a number of manufacturing problems, due to the large number of component parts involved, which parts must be made separately, to a relatively high degree of precision, and then assembled together to produce the finished machine. In an attempt to solve the manufacturing problems involved, a number of known compressors feature only a very small number of component parts, which, however, are difficult to dismantle and/or service.

SUMMARY OF THE INVENTION

The aim of the present invention is to provide a portable motor-driven compressor set which is cheap and easy to produce, and which may be serviced easily by virtue of its comprising a compressor which may be assembled and dismantled easily despite the small number of component parts involved. With this aim in view, according to the present invention, there is provided a portable motor-driven compressor set comprising a motor and an opposed-piston compressor driven by a rotary output shaft on the said motor; characterised by the fact that the said compressor comprises a top and bottom head substantially and specularly identical to each other and each comprising a valve plate having a pair of side-by-side seats for respective automatic valves; a cylinder located next to the said seats, on the opposite side to a finned surface on the valve plate, and housing a respective sliding piston; and a cup-shaped half casing having means for assembly to the said motor; the said valve plate, cylinder and half casing on each head being formed integral in one piece, and the said half casings being fitted together end-to-end and one on top of the other, with their respective cylinders facing and coaxial with each other; the respective pistons being connected rigidly together by means of a rod having a centre slot housing the said output shaft on the said motor, and also being formed integral in one piece and with the said rod; the said rod presenting a seat for a cam having a rolling bearing and fitted on to the said output shaft so as to transmit reciprocating motion to the said pistons; and the said heads presenting respective internal ducts formed partly inside the said valve plates and partly through respective side walls on the said half casings, and communicating with each other.

BRIEF DESCRIPTION OF THE DRAWINGS

One embodiment of the present invention will be described by way of a non-limiting example with reference to the accompanying drawings, in which.

DETAILED DESCRIPTION OF THE INVENTION

Figure 1:
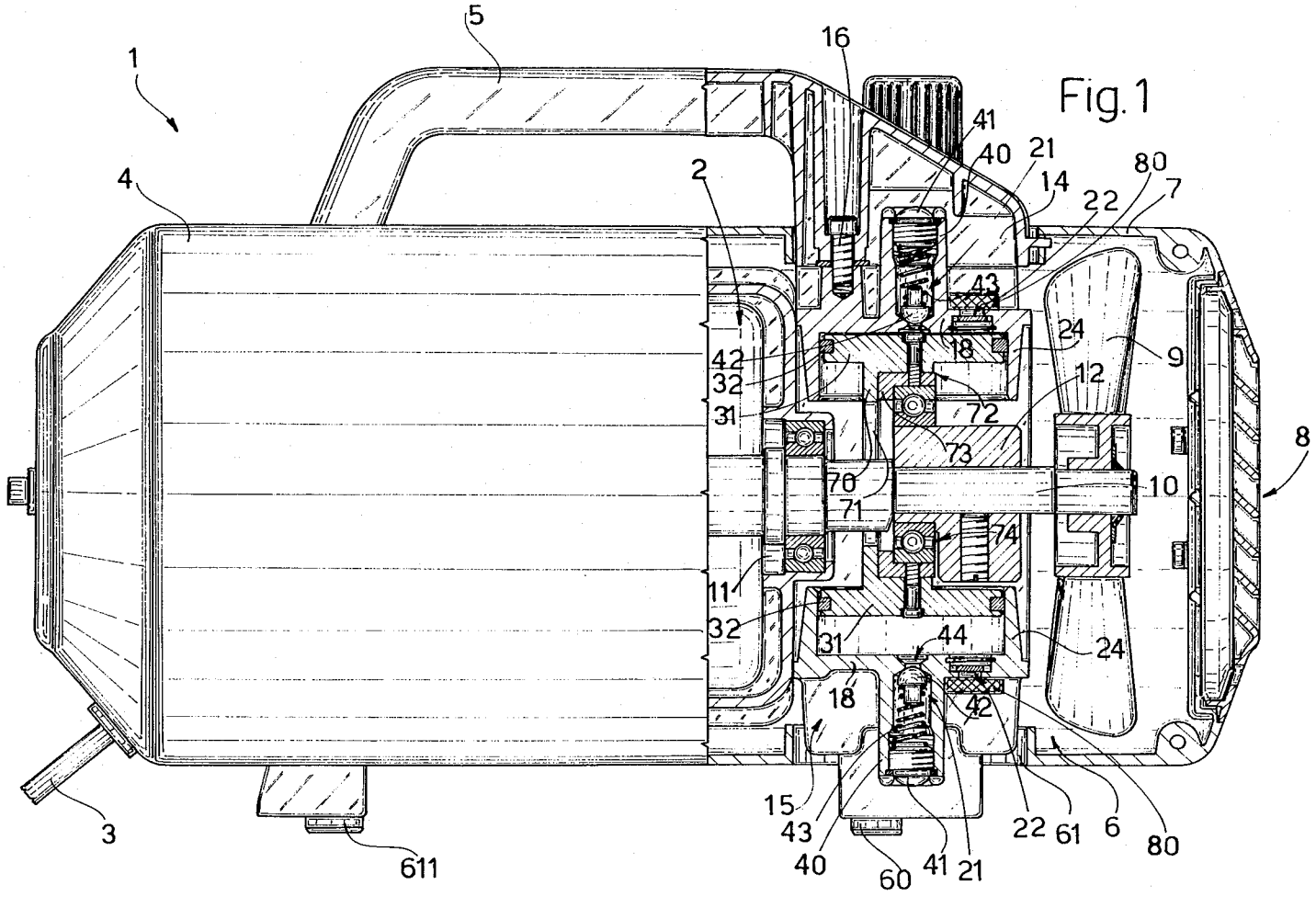
FIG. 1 shows a partially-sectioned longitudinal view of a portable motor-driven compressor set in accordance with the teachings of the present invention.

No. 1 in FIG. 1 indicates a portable motor-driven compressor set comprising a motor 2 of any known type, preferably electric, supplied by an electric cable 3 and housed inside a casing 4 preferably having a handle or grip 5; and an opposed-piston compressor 6 housed inside a portion 7 of casing 4 projecting in relation to motor 2, having a screened ventilation opening 8, and housing, in addition to compressor 6, a known type of cooling fan 9 and a rotary output shaft 10 of motor 2 for driving compressor 6 and on the free end of which is fitted fan 9. Shaft 10 projects from motor 2 on which it is supported by a bearing 11, and is fitted in known manner, on its mid portion, with a cam 12 consisting of a cylindrical bush, the axis of symmetry of which does not coincide with that of shaft 10.

Figure 2:
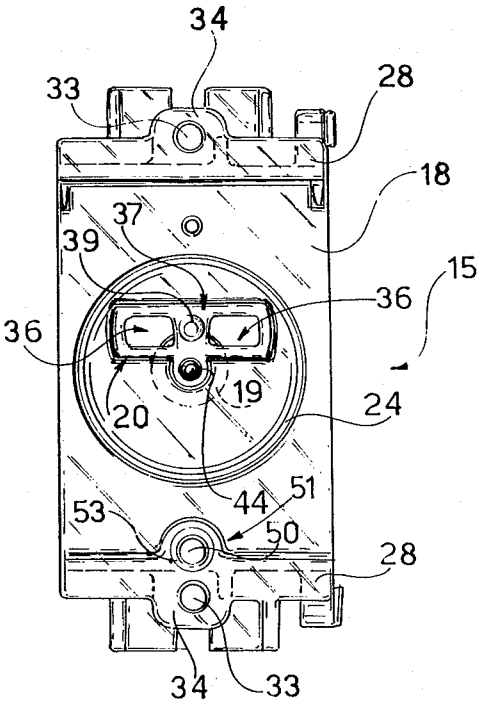
FIG. 2 shows a top plan view of a detail on the motor-driven compressor set in FIG. 1.
Figure 3:
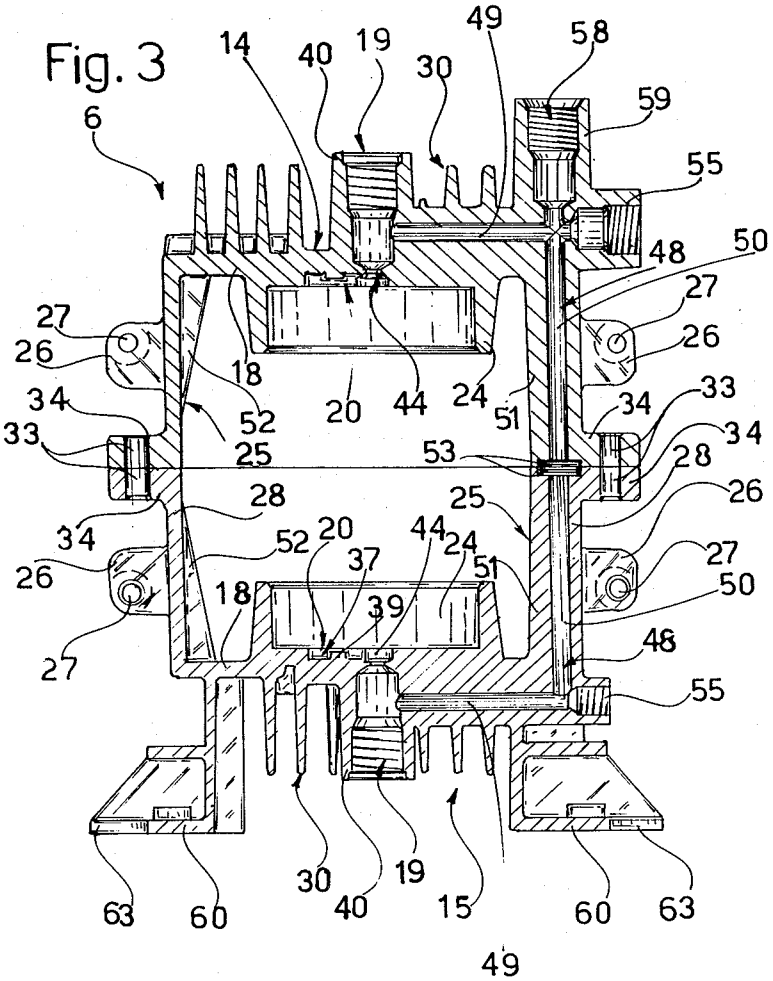
FIG. 3 shows a cross section of the compressor forming part of the set in FIG. 1.

As shown also in FIGS. 2 and 3, compressor 6 comprises a top head 14 and a bottom head 15 substantially and specularly identical to each other, mounted one on top of the other and secured to casing 4, for example, by means of screws 16 of which only one is shown for the sake of simplicity. As heads 14 and 15 are substantially identical, except for a few minor details, the corresponding functional parts are indicated using the same reference numbers. Each head 14 and 15 comprises a valve plate 18 having a pair of side-by-side seats 19 and 20 for respective substantially known automatic valves 21 and 22; a cylinder 24 arranged in such a manner that, when viewed from the top (FIG. 2), the said seats 19 and 20 are enclosed inside the same; and a cup-shaped half casing 25 having means for assembly to motor 2, said means consisting of tabs 26 having respective holes 27 through which half casings 25 are secured, by means of ties (not shown), to motor 2. According to the present invention, half casing 25, cylinder 24 and plate 18 on each head 14 and 15 are formed integral in one piece, preferably die-cast in aluminium, and half casings 25, which are formed without the front walls, present only respective opposite side walls 28, which represent a continuous extension of plates 18 perpendicular to the same. Half casings 25 thus present a substantially U-shaped cross section, as shown in FIG. 3, the end wall being defined by respective valve plate 18, and the said plate 18 presenting a respective cylinder 24 projecting perpendicularly from the centre, on the opposite side to a finned surface 30 on the outside of each plate 18. The said cylinders 24 house respective sliding pistons 31 having respective known non-lubricated sealing rings 32, and are arranged facing and coaxial with each other when respective half casings 25 are fitted on top of each other and end-to-end (FIG. 3) by means of respective screws (not shown) fitted through respective holes 33 in respective flanges 34 defining half casings 25 on the opposite side to finned surfaces 30 on respective valve plates 18. With reference to FIG. 3, the seat 20 of each plate 18 is formed peripherally next to the wall of respective cylinder 24, and is defined by a pair of side-by-side through slots 36 designed to connect the inside of cylinder 24 with the atmosphere; by a shallow recess 37 formed on plate 18 on the cylinder 24 side, so as to surround slots 36, and designed to house a pair of known shutter plates constituting automatic valve 22; and by means 39 for locking the said shutter plates inside recess 37, over slots 36, and consisting of a shank formed in relief inside recess 37 and on to which the said shutter plates may be clicked or upset, or, according to a possible variation not shown, consisting of a threaded hole formed in recess 37 in place of shank 39 and inside which may be fitted a screw, the head of which locks the said shutter plates inside recess 37. Each seat 19, on the other hand, is formed coaxial with respective cylinder 24, and is defined by a threaded sleeve 40 formed integral in one piece with plate 18 on the opposite side to cylinder 24 and extending perpendicular to plate 18 on the finned surface 30 side. Each sleeve 40 is closed outwardly by a threaded cap 41, and houses a plug 42 designed to move, by virtue of a spring 43, against a hole 44 formed through plate 18 and connecting the inside of sleeve 40 to the inside of cylinder 24 via a valve 21 consisting of the said plug 42 and spring 43. According to the present invention, each of seats 19, which are the ones designed to collect the compressed air produced by compressor 6, is connected to a duct 48 formed inside each of heads 14 and 15, partly inside plate 18 and partly inside lateral wall 28, which ducts 48 communicate with each other when half casings 25 are placed one on top of the other. In more detail, a first portion 49 of each duct 48 is formed through and parallel with plate 18, so as to connect the inside of sleeve 40 to a second portion 50 of duct 48, which second portion 50 is formed through and parallel with wall 28 and perpendicular to the said first portion 49. In more detail, the said second portion 50 is formed inside a semicylindrical rib 51 projecting from one of walls 28 on half casing 25, in the direction of cylinder 24, and opposite an oblique strengthening rib 52 formed on the other wall 28. Respective portions 50 of ducts 48 are formed coaxial with each other, and at least one terminates in a seat 53 designed to house a known type of seal (not shown) for connecting portions 50 in fluidtight manner when half casings 25 are fitted together. Each said half casing 25 is also provided laterally with a threaded union 55 connected to the intersection of portions 49 and 50 of duct 48 and designed to enable one or both of cylinders 24 to be connected to a supply pipe (not shown) on motor-driven compressor set 1 (when only one union 55 is used, the other is plugged). By virtue of connecting respective ducts 48 on heads 14 and 15, the compressed air pressure produced by compressor 6 as a whole may be regulated by a single known type of regulating valve (not shown in FIG. 1) housed inside a seat 58 formed coaxial with duct portion 50 in top head 14, in particular, inside a further internally-threaded sleeve 59 formed beside sleeve 40 and projecting perpendicularly from plate 18 on the finned surface 30 side and on wall 28 provided with rib 51. The said seat 58 and sleeve 59 are only provided on top head 14 and represent a first difference between top and bottom heads 14 and 15. If compressor 6 is operated together with a compressed air tank, however, seat 58 and sleeve 59 may either be dispensed with or plugged. Another difference between top and bottom heads 14 and 15 is that a pair of feet 60 are formed integral in one piece with plate 18 on bottom head 15, on the finned surface 30 side, and project from casing portion 7 through a respective opening 61. Feet 60 provide for conveniently supporting the entire motor-driven compressor set 1, especially if motor 2 is also provided with feet 611 arranged symmetrically in relation to feet 60. Feet 60 are also preferably provided with slots 63 for securing compressor 6 to a known type of compressed air tank (not shown) by means of screws or similar fastening means. According to the present invention, pistons 31 are also formed integral in a single die-cast piece, by virtue of being rigidly connected by a centre rod 70 also formed integral with pistons 31. The said centre rod 70 presents a centre slot 71, through which shaft 10 is fitted through the entire compressor 6, and a cylindrical seat 72 having its axis of symmetry coincident with that of cam 12. The said cylindrical seat 72 is formed next to cam 12 and is fitted inside with a guide shoe 73 inside which is fitted a rolling bearing 74, in turn, fitted on to cam 12.

According to a preferred embodiment of the present invention, valves 22 are fitted in known manner with known silencing filters 80, as shown schematically in FIG. 1. Operation of the motor-driven compressor set according to the present invention is as follows. When motor 2 is started up, shaft 10 is turned so as to turn cam 12, which is free to turn in relation to rod 70 and respective pistons 31 by virtue of bearing 74 between cam 12 and seat 72. Being eccentric, however, in relation to the rotation axis of shaft 10, cam 12 causes rod 70 to move back and forth, thus causing pistons 31 also to slide back and forth inside respective cylinders 24. The reciprocating motion of pistons 31 produces a vacuum in one of cylinders 24, thus causing valve 22 to open and outside air to be sucked into the cylinder. At the same time, the air inside the other cylinder 24 is compressed and, when sufficient pressure is produced for overcoming the resistance of spring 43, opens automatic valve 21 and is exhausted into duct 48. The compressed air produced by both cylinders 24 is combined inside ducts 48 and then supplied to the user equipment via one or both unions 55.

The advantages of the motor-driven compressor set according to the present invention will be clear from the foregoing description. In particular, it features a compressor of straightforward design, which is easy to produce and, while presenting only a very small number of component parts, is easy to assemble and dismantle, provides for troublefree operating performance, and is of compact design both length- and crosswise. Furthermore, by virtue of the modular structure of motor-driven compressor set 1 as a whole, only minor changes are required for adjusting the power and operating characteristics of the set. To those skilled in the art it will be clear that changes may be made to the set as described and illustrated herein without, however, departing from the scope of the present invention.

I claim:

1. A portable motor-driven compressor set (1) comprising a motor (2) and an opposed-piston compressor (6) driven by a rotary output shaft (10) of the said motor (2); said compressor (6) comprising:

(i) a top (14) and bottom (15) head substantially and specularly identical to each other and each comprising, in combination:

(i.a) a cup-shaped half casing (25) having means (26,27) for assembly to the said motor (2), and comprising an end wall defined by a respective valve plate (18) having a pair of side-by-side seats (19,20) for respective automatic valves (21,22), and a pair of opposed side walls (28), which represent a continuous extension of said valve plate (18) perpendicular thereto, each of said half casing (25) being formed integral in one piece; and (i.b) a cylinder (24) located next to said seats (19,20) and projecting perpendicularly from the center of said valve plate (18), on the opposite side to a finned surface (30) on the outside of the valve plate (18), each of said cylinders (24) being formed integral in one piece with the respective said half casing (25);

(ii) a pair of pistons (31) connected rigidly to each other by means of a rod (71) provided with a center slot (72) housing said output shaft (10) of the motor (2) and with a cylindrical seat (72) eccentric with respect to said output shaft (10); said pistons (31) and said rod (71) being formed integral in one piece and each of said pistons (31) being slidably housed inside one of said cylinders (24); and (iii) a cam (12) angularly connected on to said output shaft (10) and fitted via a rolling bearing (74) inside said eccentric seat (72) coaxial therewith, so as to transmit reciprocating motion to said pistons (31);

said half casings (25) being fitted together end-to-end and one on top of the other, with their respective cylinders (24) facing and coaxial with each other; and each of said heads (14,15) further comprising a respective internal duct (48) formed partly inside said valve plate (18) and partly through said side walls (28), said ducts (48) of said superimposed half casings being communicating with each other.

2. A portable motor driven compressor set as described in claim 1, further comprising half casings (25) formed, without front walls, comprised of opposite side walls (28), representing a continuous extension of plates 18, perpendicular to the same, the result of which being that the half casings 25 present a substantially U-shaped cross section.

3. A motor-driven compressor set as claimed in claim 1, characterised by the fact that a first seat (20) on each said valve plate (18), formed peripherally in the proximity of the wall on the respective said cylinder (24), is defined by a pair of through slots (36) designed to connect the inside of the said cylinder (24) with the outside atmosphere; by a shallow recess (37) formed on the said cylinder (24) side and designed to house a pair of shutter plates (22); and by means (39) for locking the said shutters (22) inside the said recess (37) and over the said slots (36).

4. A motor-driven compressor set as claimed in claim 1, characterised by the fact that a second seat (19) on each said valve plate (18), formed coaxially with the respective said cylinder (24), is defined by a threaded sleeve (40) extending perpendicularly in relation to the said valve plate (18) on the said finned surface (30) slide, closed outwardly by a cap (41), and housing a plug (42) designed to move, by virtue of a spring (43), against a hole (44) formed through the said valve plate (18) and connecting the said sleeve (40) to the inside of the said cylinder (24); a first portion (49) of the said duct (48) formed in each said head (14, 15) being formed through and parallel with the said valve plate (18) so as to connect the inside of the said sleeve (40) to a second portion (50) of the said duct (48), perpendicular to the said first portion (49) and formed in the said half casing (25); the respective said second portions (50) of the said ducts (48) being coaxial with each other, so as to be interconnected when the said half casings (25) are fitted together, and being connected externally by means of respective threaded unions (55).

5. A motor-driven compressor set, as claimed in claim 4, characterised by the fact that the said top head (14) comprises a seat (58) for a pressure regulating valve, which seat (58) is formed coaxially in relation to the respective said second portion (50) of the respective said duct (48).

6. A motor-driven compressor set as claimed in claim 1, characterised by the fact that the said bottom head (15) comprises feet formed integral with the respective said valve plate (18) on the finned surface (30) side of the same.

7. A motor-driven compressor set as claimed in claim 1, characterised by the fact that at least one pair (22) of the said automatic valves is fitted with silencing filters (80).

* * * * *